US005670927A

United States Patent [19]

Fennell

[11] Patent Number: 5,670,927

[45] Date of Patent: Sep. 23, 1997

[54] UNIVERSAL FUSE HOLDER AND CUT-OUT WITH BUILT-IN SAFETY FEATURES AND METHOD

[76] Inventor: Robert B. Fennell, 978 Shawnee Egypt Rd., Springfield, Ga. 31329

[21] Appl. No.: 299,622

[22] Filed: Sep. 2, 1994

[51] Int. Cl.[6] ..... H01H 71/10; H01H 71/20

[52] U.S. Cl. ..... 337/168; 337/170; 337/171; 337/176

[58] Field of Search ..... 337/171, 172, 337/173, 174, 175, 176, 177, 178

[56] References Cited

U.S. PATENT DOCUMENTS

| | | | |
|---|---|---|---|
| 2,047,365 | 7/1936 | Fox . | |
| 2,140,906 | 12/1938 | Froland . | |
| 2,204,299 | 6/1940 | Carlisle . | |
| 2,235,666 | 3/1941 | Birkenmaier . | |
| 2,296,991 | 9/1942 | Fox . | |
| 2,324,114 | 7/1943 | Schultz . | |
| 2,331,839 | 10/1943 | Link . | |
| 2,331,847 | 10/1943 | Schultz . | |
| 2,365,113 | 12/1944 | Schultz . | |
| 3,048,680 | 8/1962 | McCloud . | |
| 4,326,184 | 4/1982 | Murdock | 337/168 |

FOREIGN PATENT DOCUMENTS

| | | | |
|---|---|---|---|
| 508423 | 12/1954 | Canada | 337/178 |

*Primary Examiner*—Leo P. Picard
*Assistant Examiner*—Stephen T. Ryan
*Attorney, Agent, or Firm*—Jim Zegeer, Esq.

[57] ABSTRACT

A universal fuse holder and cut-out is provided with a slot having a length L and width W aligned with the fuse tube and engageable with the fuse tube and engageable by a projecting arm or member of a hot switch stick so as to enable safe and expedient maintenance and service, particularly in high wind and storm conditions. One contact assembly is lengthwise and rotatably mounted to accommodate long and short fuse tubes and different manufacturer styles of switch assembly.

7 Claims, 9 Drawing Sheets

UNIVERSAL FUSE HOLDER AND CUT-OUT WITH BUILT-IN SAFETY FEATURES AND METHOD

BACKGROUND AND BRIEF DESCRIPTION OF THE INVENTION

In electric power distribution systems, electric cut-outs are used to provide protection to the lines of the distribution system and various apparatus on the line such as transformers, capacitors banks, etc. Frequently in storms and at night, utility linemen and workmen are required to replace or otherwise service high, above-ground distribution fuse cut-out switches.

FIG. 1 discloses, in outline, form an array of typical prior art fuse cut-out switch assemblies. U.S. Pat. No. 4,326,184 is typical: insulator 1 is mounted on a bracket 2 and has a pair of spaced contact assemblies 5 and 8. Contact assembly 14 has a pair of aligned trunnion sockets formed therein, only one being shown. The elongated fuse tube 17 has at one end a trunnion contact end assembly with a pair of laterally extending trunnion members 47 (only one shown) receivable in the pair of trunnion sockets 33 (only one shown) and, at the opposite end 25 of the fuse tube 17, is a second latching contact end adapted to contact and latch with the second of the contact assemblies on insulator 1. A hook stick ring 40 is integrally cast as part of the drop-out hinge assembly and an operating eye 27 is integrally cast with the upper fused contact assembly. In some cases, the upper operating eye 27 automatically lifts a sleet shield and pulled with hook sticks by the lineman to disengage the cut-out switch.

In the case of removing the fuse cut-out switch for servicing or replacement and in lifting or removing the fuse holder by the use of a hook stick, particularly in storms and windy conditions (which typically is the case), the fuse tube and its switch contact assemblies frequently fall off when lifting to engage the trunnion sockets, or are blown off or it is difficult to engage the hook stick with the operating eye 27 or the hook stick ring 40. In wind storms, particularly at 40, 45 and 50 feet above ground, the lineman can have great difficulty in manipulating the hook stick (sometimes called "hot-switch stick") engagement member which projects laterally from the axis of the hook stick. The operating eye 27 and the hook stick ring 40 are made large relatively, so as to enable ease of engagement from the ground. But even these expediencies are not sufficient to make it easy for the lineman to engage the operating eye properly or the hook stick ring for lifting and/or removing the fuse holder. Frequently they jiggle and are blown off of the end of the hook stick and fall upon the head and shoulders and feet of the trouble person or assistant or other workers, sometimes injuring them. At any rate, at night, it is quite difficult and dangerous to work and can be time consuming.

Attempts to solve this problem have not been particularly well received because of their complexity and difficulty of use. For example, in Manning U.S. Pat. No. 4,480,244 an apparatus is provided for remote closing of fuse circuits in which a pivotally carried fuse tube has a crank extending therefrom that is to be positioned and a cord extending to the ground for swinging the fuse tube to an upward position to close the circuit with the apparatus normally sliding off the fuse tube and in a closed position but, being removable by pulling the cord from the ground. It will be noted in the Manning patent the large size operating eye and the large size hook stick rings.

In Mannen U.S. Pat. No. 2,936,193, a switch stick for manipulating an installation of fuses on overhead lines is disclosed which has a shaft grope operated carrier slidable along the stick for releasably supporting the fuse member with the stick having its upper end to engage a fused mounting.

Hubbard U.S. Pat. No. 3,810,060 uses a lanyard and lever arm to operating the switch. Reference is also made to the following U.S. patents which disclose various shapes and configurations of operating eye and hook switch rings:

Mee et al. U.S. Pat. No. 4,636,764
Lemmon U.S. Pat. No. 2,172,143
Bronikowski U.S. Pat. No. 3,374,329
Schultz U.S. Pat. No. 2,365,113
Sant U.S. Pat. No. 2,703,349
Jackson, Jr. U.S. Pat. No. 4,307,369
Schmunk U.S. Pat. No. 4,313,100
Birknmeir U.S. Pat. No. 2,235,666
Billar U.S. Pat. No. 4,414,527
McNaghten, et al. U.S. Pat. No. DES 278,331

While the invention is particularly applicable to cut-out type distribution switches, it will be readily apparent to those skilled in the art that the safety features of the invention, in its broader aspects, are applicable to interrupter switches for live-line switch installations as well.

The invention features a high above-ground distribution fuse cut-out switch having a pair of spaced contact assemblies supported and spaced by a ceramic insulator and appropriately carried on a mounting member upon a power pole, say 30–50 feet above ground. One of the spaced contact assemblies has a pair of laterally aligned trunnion sockets formed therein and an elongated fuse assembly having a trunnion contact end with a pair of laterally extending trunnion members receivable in the pair of trunnion sockets. A second latching contact end is adapted to contact and latch the second of the contact assemblies when the fuse assembly is rotated on the trunnions. The invention is directed to means to safely and efficiently facilitate the mounting of the elongated fused assembly to engage the pair of spaced contact assemblies from the ground level by a hot switch stick or hook stick. According to the invention, the trunnion contact end includes an elongated slot having a width W which slot is preferably substantially aligned with the elongated fuse tube. The hot/switch stick has an axis and a stub shaft or member projecting laterally of the hot stick length axis with an enlargement on the end of the projecting member which is larger than the slot width W. It has an intermediate portion of the projecting member which is narrower than the slot width W such that the projecting member easily slides in the slot and the weight of the fuse tube and pairs of contact ends in the slot being of a length such that jiggling and wind forces are insufficient to displace the projection from the slot while the hot/switch stick is being raised to fit the laterally extending trunnion members into the trunnion sockets. The safety slot is aligned with the fuse tubes such that the laterally projecting member on the hook switch or hot switch stick can be rested along the length of the fuse tube and guided along the fuse tube and into the slot to thereby facilitate engagement of the hook stick switch when the trunnion members are in the trunnion sockets for removal of the trunnion members and fuse assembly from the trunnion sockets. Furthermore, an open-sided operating eye member is provided with the open side aligned with the tube so that the projecting member on the hot/switch stick can engage and be easily guided by the tube into engagement with the hook from the ground level. In this way, when a switch is to be removed for servicing and/or replacement, the lineman on the ground can easily press the projecting member or lateral shaft of the hot/switch stick on the fuse tube (anywhere along the length) from the ground and then be guided upwardly and into the hook portion of the operate eye and thereby pull downwardly so as to open the switch (in those switch types that operate in that manner). Then, placing the projecting member of the hot/switch stick on the opposite side of the tube, the lineman can guide the projecting member into the slot and lift the pair of laterally extending trunnion members out of the trunnion sockets down to the ground without the fuse cut-out assembly falling off of the hook switch and hitting the trouble person on the head or shoulders or injuring other workmen, or getting lost in trees, brush, streams, ponds or lakes. The invention can save ¼ to ½ the normal replacement time.

The different manufacturers have not generally made their units compatible with one another's. Accordingly, there are some fuse assemblies which are relatively long and others with are somewhat shorter and some have different latch mechanisms.

Another feature of the present invention provides for rotary and length-wise adjustment of the trunnion contact assembly along the axis of the fuse tube so that the universal fuse holder of the present invention will fit long as well short fuse holders so that the trouble person, if the trouble person has to go out at night, need to have one type of fuse holder to fit many different types of switches instead of having several on the repair truck. This makes it easy to accommodate several different types of cut-out fuse switches. It takes a short period of time to adapt the universal fuse holder—even in a storm it wouldn't be hard to do. In some cases, the lineman needs to take a hacksaw to saw off a short portion of the fuse.

In summary, the invention features a safety device that enables the lineman to raise and lower and operate the fuse in a much safer fashion, particularly in storms so that they do not get hurt during storms and do not loose the fuse holders in bushes and in the trees, rivers and canals when it falls out of the hot/switch pole. In contrast, in a conventional cut-out switch, the lineman must insert the projecting member into a ring of about 1¼ to 1½ inch diameter and, with the wind blowing it is almost impossible. In the present invention, the tube is used as a guide to slide right into the slot and when the wind is blowing this gives the target of 8 inches to 1 foot for the lineman to rest the projecting member against the fuse tube body (the different distances being due to the different lengths of the fused bodies). Moreover, the lineman has to come into it from the side and, being on the ground and viewing from the side has a different viewing angle of the hole in the hook ring. And, as noted above, when the wind is blowing and on a 35 to 40 foot pole and viewing the hole from the ground and coming in from the side and ring the hole and take it up which makes it very difficult installing in inclement weather and in the dark. The invention solves these problems in an efficient and safe way.

DESCRIPTION OF THE DRAWINGS

The above and other objects, advantages and features of the invention will become more apparent when considered with the following specification and accompanying drawings.

DETAILED DESCRIPTION OF THE INVENTION

FIG. 1*a* will be described in detail as it is applicable to the functionality of these type switches in general.

Figure 1:
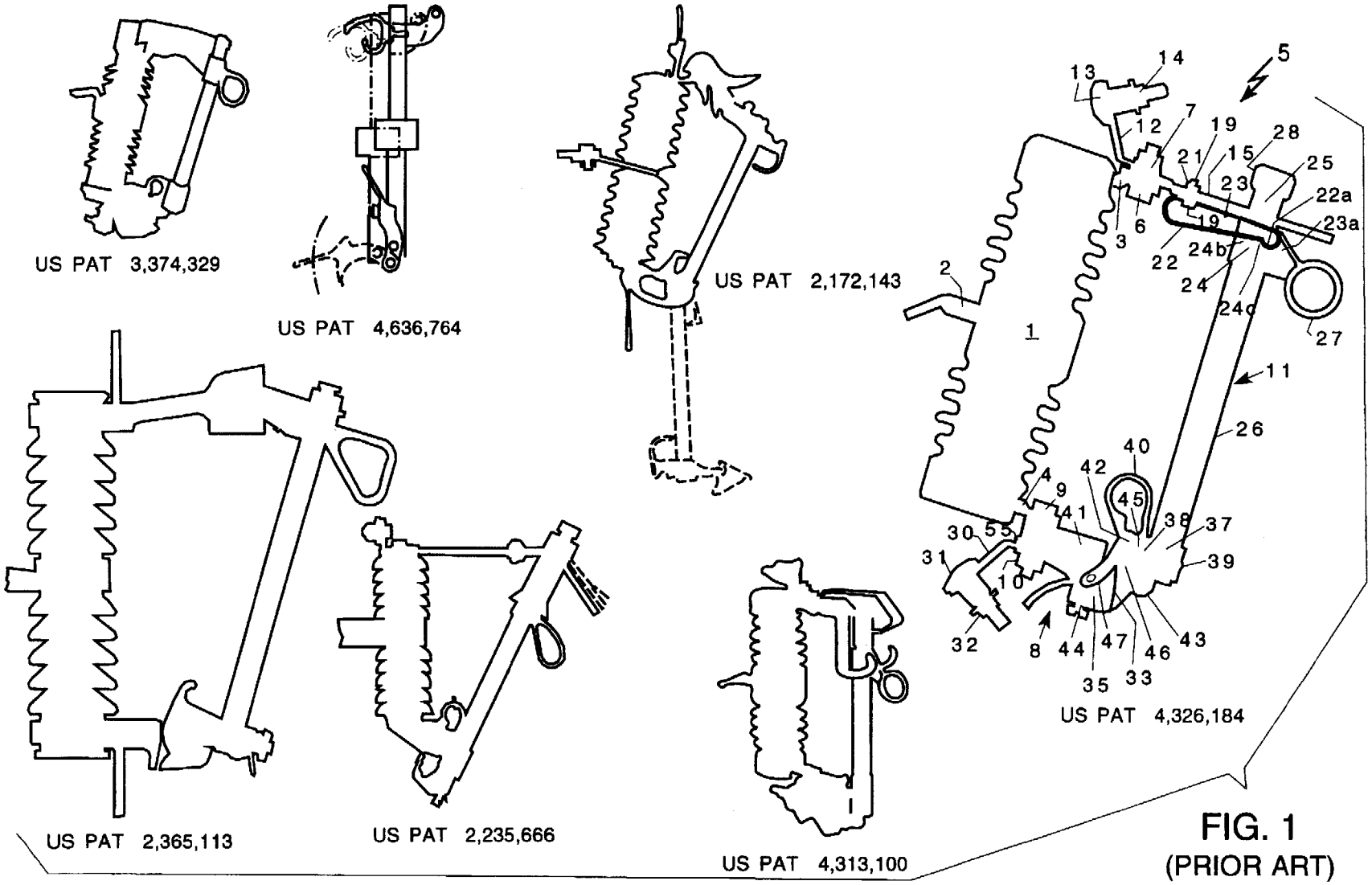
FIG. 1 (PRIOR ART)
FIG. 1 is a collage of prior art interrupters showing various operating eyes and hook stick rings from several of the patents discussed above.

FIG. 1*a* is FIG. 1 of U.S. Pat. No. 4,326,184 and is described in that patent as follows:

" . . . The numeral 1 designates a conventional insulator provided with a supporting bracket 2. As is well known, supporting bracket 2 is secured by suitable means to a supporting structure such as the cross-arm of an electric line pole. Secured to the upper end of insulator 1 is a mounting bracket 3, while a similar mounting bracket 4 is secured to the lower end of insulator 1.

The upper terminal generally designated by the numeral 5 is secured to bracket 3 by means of bolt 6 and associated nut 7 while the lower terminal generally designated by the numeral 8 is secured to bracket 4 by means of bolt 9 and nut 10. The fuse holder generally designated by the numeral 11 interconnects the lower terminal 8 with the upper terminal 5 when enclosed circuit position as shown in FIG. 1. As is well known, a fusible element is mounted within the fuse holder and is electrically connected with terminal 5 and 8. Upper terminal 5 includes a terminal stud 12 secured in place by bolt 6 and nut 7 and provided with connecting bolt 13 and its associated nut 14 which constitute means for interconnecting a distribution circuit conductor with the upper terminal 5 of the cut-out. Terminal element 15 is supported on bracket 3 by bolt 6 and nut 7 . . .

For holding the fuse holder 11 in its closed circuit position . . . latching means is provided and includes a spring element constructed of spring material identified by numeral 22 which is mounted to terminal element 15 by means of the bolt 19 and the nut 21. The right-hand end of the spring element 22 is in the form of an arcuate element 22A and is enveloped within a complementary arcuate portion 23A of a yieldable conducting element 23. Conducting element 23 is also mounted by bolt 19 and nut 21 and is secured in contact with terminal stud 12 and by bolt 7. Similar spring 22B and associated yieldable conducting element 23B are formed alongside spring 22 and yieldable conductor 23 . . . and are secured by bolt 18 and nut 20 as well as by bolt 7 . . .

For engaging the latching means comprising spring 22 and yieldable conducting element 23, a latch element 24 is integrally formed with the metallic contact 25 which is secured to the top fuse tube 26 which is formed of insulating material. Contact 25 of course is formed of conductive material and is provided with a manipulating ring 27 and closure cap 28 of known construction and function . . .

The lower terminal 8 includes terminal stud 30 mounted by bolt 9 and nut 10 on bracket 4. Connecting bolt 31 and associated nut 32 are used in known manner to form a connection with a distribution line conductor. Lower terminal 8 also includes a pair of laterally spaced jaws 33. . . .

The structure associated with the lower end of the fuse tube 26 comprises a collar 37 secured to the lower end of fuse tube 26 by means of a pair of pins 38 and 39 which are of known construction function and a hook 40 is integrally formed with collar 35 and is arranged and receive a part of a hook stick to facilitate mounting the fuse holder and the associated fusible element in known manner.

Pivotally connected with the collar 37 is conducting hinge element 41. The pivotal connection between the collar 37 and the conducting element 41 is by means of pin 42. Conducting element 41 is maintained in position . . . by means of conductor 43 which extends into fuse tube 26 and connects with the fusible element, not shown. Conductor 43 is secured by bolt 44 to conducting hinge element 41 so that the part 45 of conducting element 41 is held in abutting relationship with the stud 46 integrally formed on collar 37. . . .

With the fuse holder armed with a fuse link and having a button head in contact with contact 25 and with conductor 43 secured in position by bolt 44 . . . the fuse holder may be mounted in a close circuit position by simply inserting a stick through hole 40 and by elevating the fuse holder upwardly to allow the trunnions 47 to enter the jaws 33. Thereafter, the hook stick is removed from aperture 40 and is inserted into the ring 27 and pushed upwardly. This swings the fuse holder in a counter-clockwise direction about trunnions 47 . . . and causes the latch elements 24 and 24A to slide underneath the latching means 22, 23 so that the parts then occupy the position shown in FIG. 1. . . . "

The description of the manner using the manipulating ring or operating eye 27 and hook or hole 40 is quite common in the art and, as other disclosures of the prior art shown in FIG. 1 reveal, this is the predominant practice used in the industry.

THE PRESENT INVENTION

Figure 7:
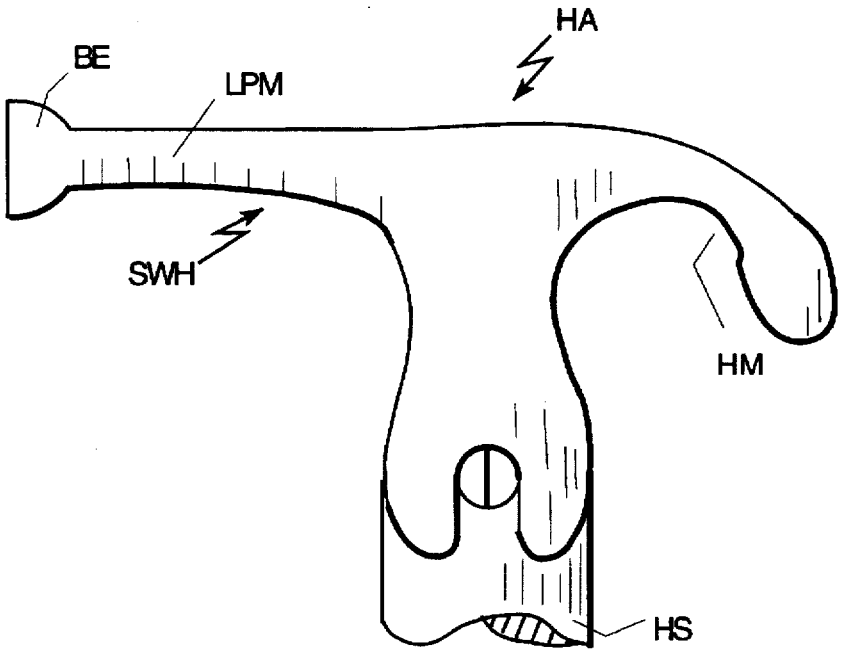
FIG. 7 (Prior Art)
FIG. 7 is a side elevational view of a conventional hook switch stick head which is adapted to fit on the end of an extensible or telescoping pole.
Figure 9A:
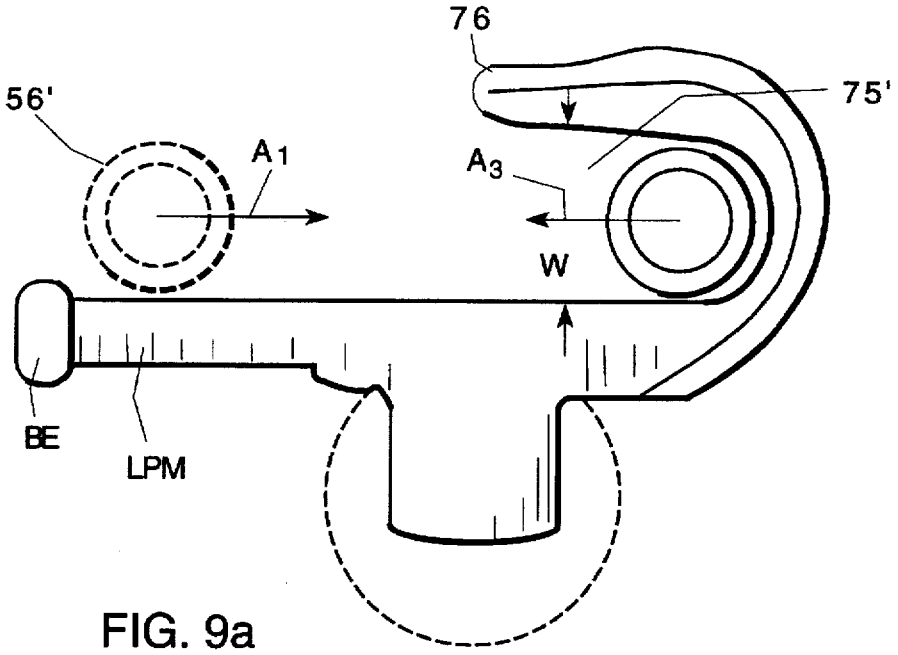
FIGS. 9*a* and 9*b* are top and side elevational views of a further embodiment of the invention.
Figure 9B:
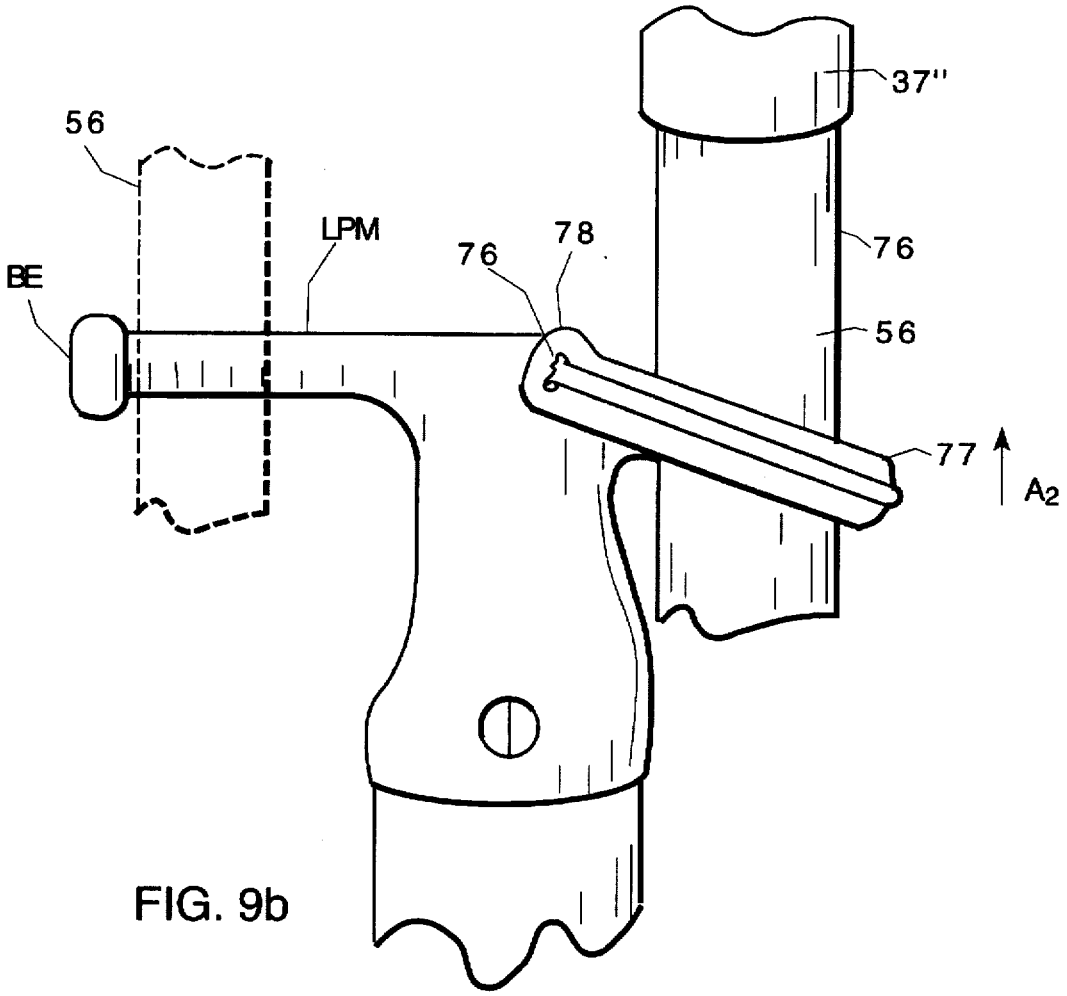

The electrical functioning of the fuse element and switch are not in any way changed according to the present invention. The present invention is directed to the basic change in the hook stick ring or hook element 40 in FIG. 1*a* which has been replaced by a slot which is aligned with the elongated axis of the tube and having a length L such that jiggling or wind forces are insufficient to displace the projection LPM on the hot/switch stick from the slot. A side elevations view of the conventional head SWH and its laterally projecting member LPM, and enlargement BE of a conventional hot/switch stick is shown in FIG. 7. (A modified switch stick head is shown in FIGS. 9*a* and 9*b*).

The laterally projecting member LPM on the hot/switch stick has an enlargement or knob which is sufficiently larger than the width W of the slot and an intermediate projection portion LPM which is narrower than the slot width W such that the projecting member slides easily in the slot and the weight of the fuse tube and pairs of contact ends in the slot being of such length that the jiggling and wind forces are insufficient to displace the projection from the slot while the hot/switch stick is being raised to fit the laterally projecting trunnion members into the trunnion socket or lowered for service or replacement.

Moreover, the mouth of the slot serves as a guideway to the slot and operates cooperatively with the side of the tube to easily and efficiently lead the projecting member into the slot so that the fuse element can be easily engaged by the trouble person manipulating the hot switch stick from the ground in high winds and at night.

Secondly, the operating eye or manipulating ring is fashioned into an open hook with the opening in the hook being aligned with the fuse holder or body tube 11 so that during servicing, the lineman merely rest the hot/switch stick projection on the fuse body and slide it upwardly so as to enter the opening in the hook or operating eye and thereby pull to disengage and operate the switch (for some switch constructions, this is not needed).

Figure 2:
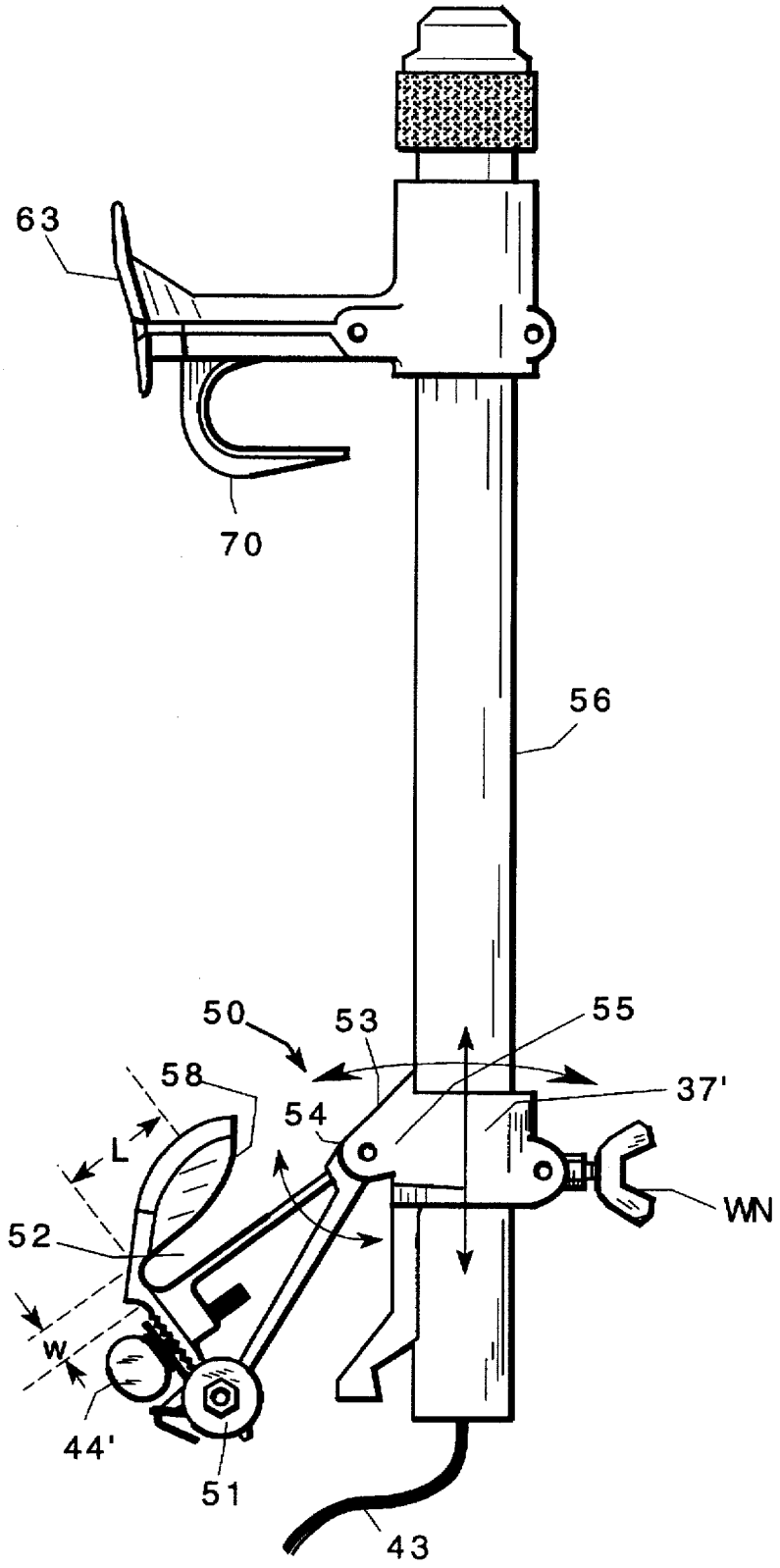
FIG. 2 is a side elevational view of a switch cut-out incorporating the invention.

Referring to FIG. 2, the trunnion contact end 50 includes a pair of laterally extending trunnions 51 (only one shown) for reception in the trunnions of a conventional trunnion sockets (described earlier herein in connection with FIG. 1). Conductor 43' is secured in position by wing nut bolt 44' and, via the trunnion sockets and conducting hinge (also described earlier) electrical connection to the line conductor is made. The parts are conventional and need not be described in great detail.

Instead of a hook stick through hole or loop, a slot 52 is provided with the length L of the slot being such that the weight of the fuse tube and pairs of contact ends in the slot being of such a length L that the jiggling and wind forces are insufficient to displace the projection LPM from the slot while the hot stick switch is being raised to fit the laterally extending trunnion members 51, 52 into the trunnion sockets or lowered for servicing. In this embodiment, the portions 53, 54 of collar 37 and clevis 55 are filled-in as indicated, so as to provide a smooth guiding transition for hot stick projection member LPM from the fuse tube body 56. In addition, the mouth 58 of slot 52 is diverging in the direction indicated so that when the laterally projecting member LPM of the head HA of the hot switch stick engages the side of the tube body 56, while the switch assembly is in a hanging position with the trunnions 51 in the trunnion sockets 35 (of FIG. 1), the laterally projecting member can be guided as the trouble person pushes or elevates the hot switch stick upwardly and guided by the fillets 53, 54 and mouth 58 into slot 52.

In addition, when the trouble person has located the fuse assembly into position with the trunnion arms 51 fitted in the trunnion sockets, he can then lower the hot switch stick sliding it along the fuse body 56 and swing the fuse body in an arc with the trunnions 51 as an axis so as to engage the upper contact assembly and thereby engage the fuse switch.

Figure 3:
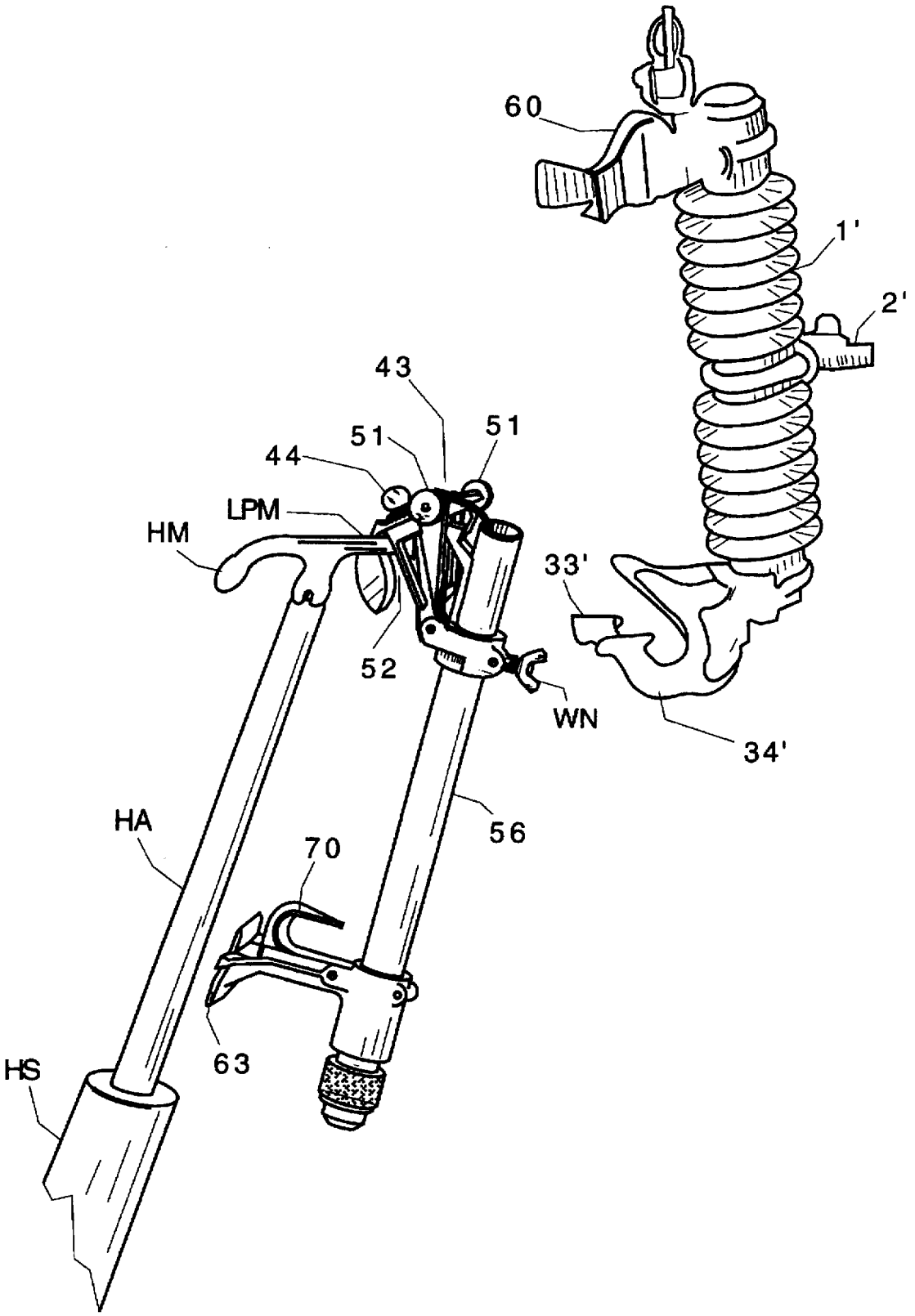
FIG. 3 is a side perspective view showing the fuse tube assembly being lifted on a pole to a high elevation for mounting on the insulator.

FIG. 7 illustrates the conventional hot switch stick HS and its conventional head assembly HA which has a laterally projecting member LPM, enlarged end BE, and a hook member HM. In the embodiment shown in FIG. 4, the switch mount is of the type manufactured by the Southern States Manufacturing Company which is better shown in FIGS. 3, 4 and 5, has a shield or hood 60 which sleet shields and protects the contact assembly (not shown in FIG. 2) which is engaged by conductive contact 63 so as to make electrical contact with the fuse itself.

Figure 4:
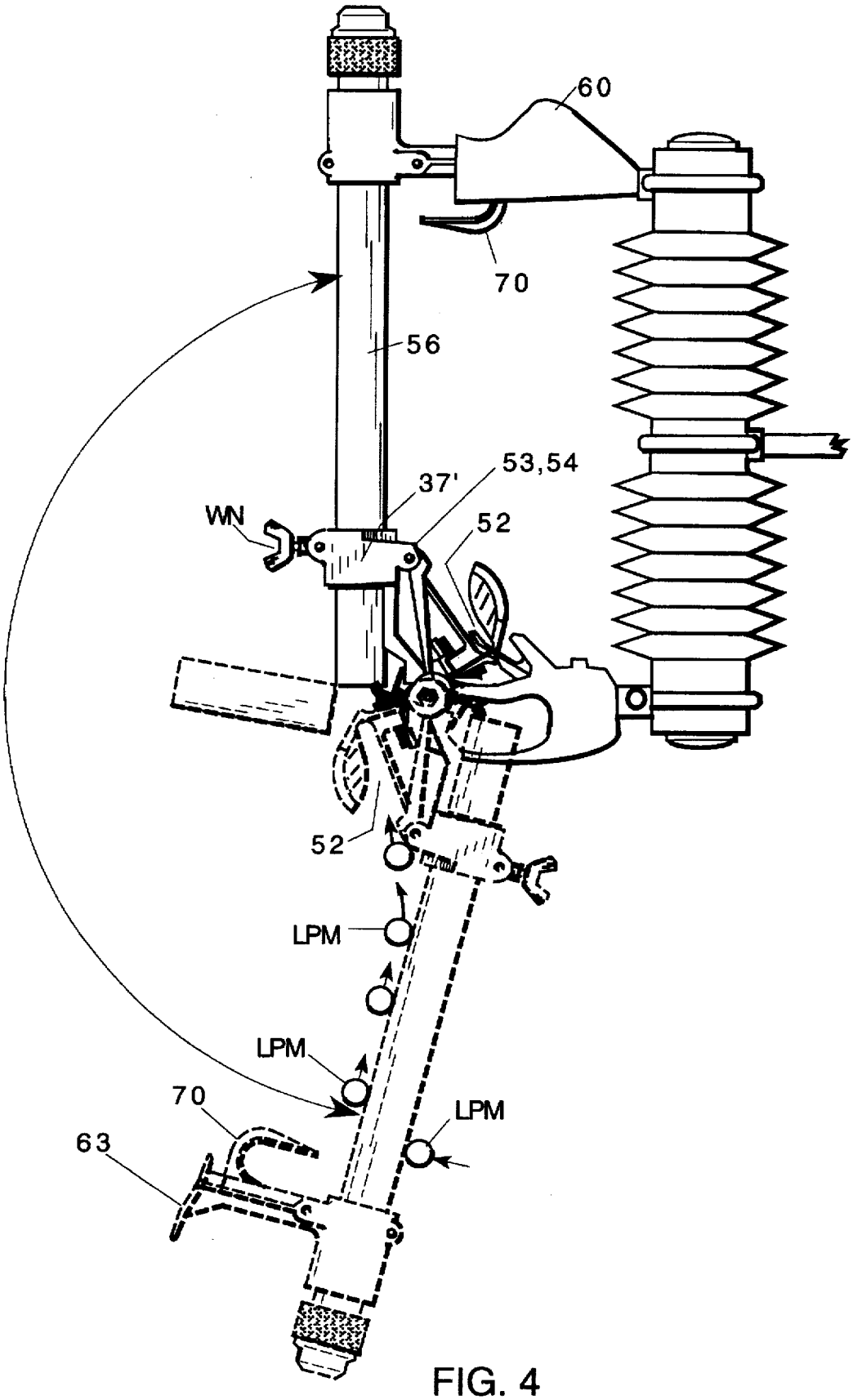
FIG. 4 illustrates the fuse tube being pivoted into operative position on the trunnions.

As shown in FIG. 4, the switch stick lateral projecting member LPM is used to engage the opposite side of tube 56 (the side to the right shown in FIG. 3) and is used to swing the fuse assembly in the trunnion with the trunnions in the trunnion sockets about an arc so as to cause the contact end 63 to enter the shield assembly 60 and elevate it and make latching contact in a conventional fashion.

In order to allow the fuse assembly of the present invention to accommodate longer as well as short mounts (Southern States), the trunnion collar 37' is adjustably fitted on tube 56 and held in position by wing nut WN. As indicated in FIG. 4, the wing nut has been loosened, and collar 37' slid along the tube body to the proper length for the fuse tube 56 and then the end of the fuse is sawed-off with a hack saw and the conductor wire 43' fitted in and clamped in clamp 44' as described earlier. In this type switch assembly, in order to disengage the switch, the switch shield 60 is pushed upwardly by the lateral projecting arm LPM and the switch releases and the fuse and contact assembly pivots on the trunnion sockets to the lowered position shown with dashed lines in FIG. 4. To remove the switch, the laterally projecting member LPM is engaged with the slot side of the tube anywhere along its length (and as described extensively above, this is a major feature of the invention), and slid upwardly and guided into the slot 52 and retained on the laterally projecting member LPM by the bulbous end portion and lifted off of the trunnion sockets and lowered to the ground without falling from the stick and injuring the trouble person and other nearby workers.

Applicant has found that by making the slot of the length that extensive high winds, rain and jiggling forces do not dislodge the laterally projecting member from the slot.

Figure 5:
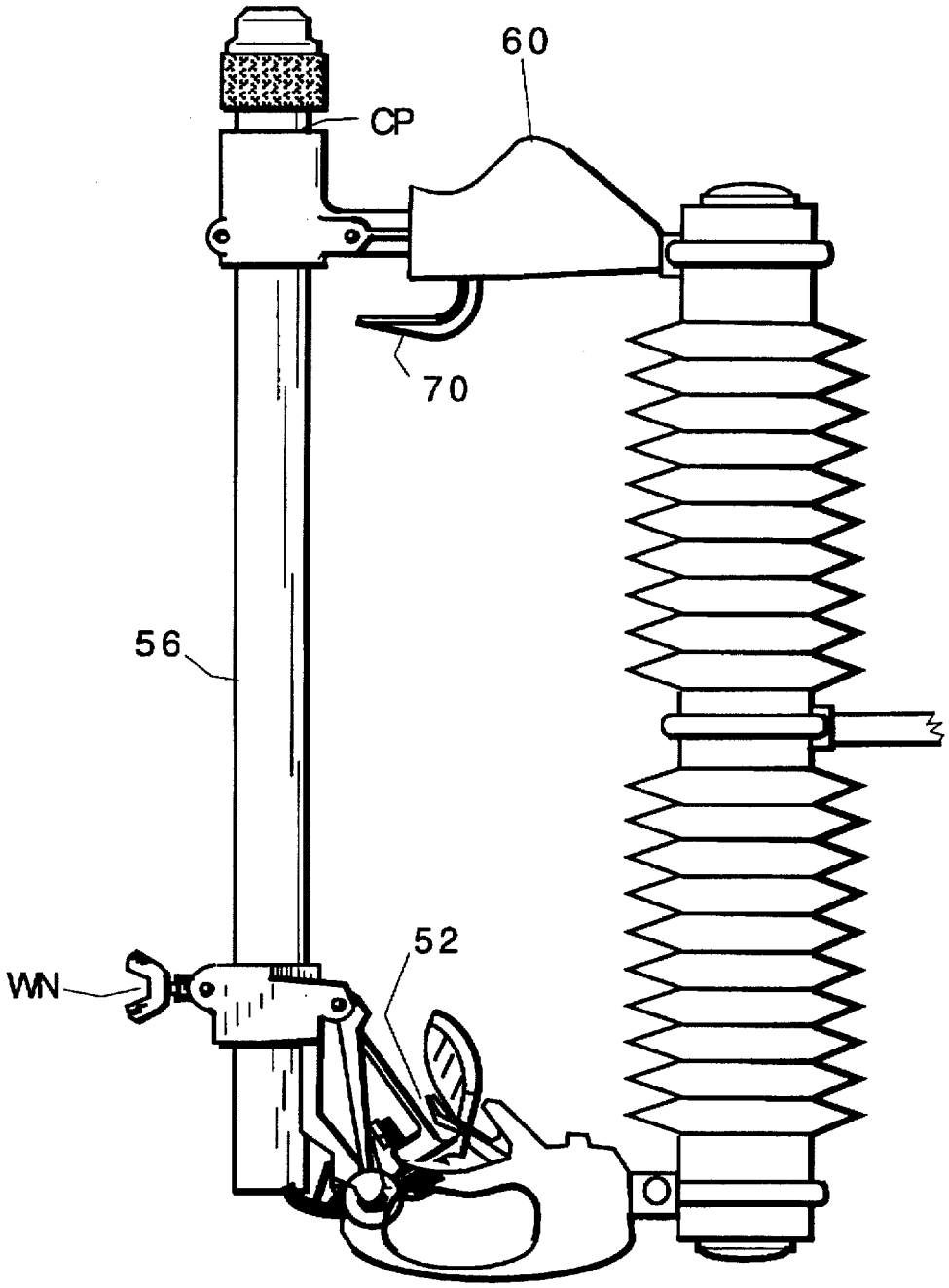
FIGS. 5 and 6*a* show the universality of the invention.

As shown in FIG. 5, the switch has been utilized without sawing-off a portion of the tube 56. (This applies to Southern States "long" fuse cut-outs.)

In the embodiment shown in FIG. **6*b*, the safety slot 51' is provided in the trunnion contact assembly and a gap has been provided in ring 75 to allow entry of the lateral projection member LPM on the hot stick head after being guided along the side of fuse tube body 56'**.

Figure 6A:
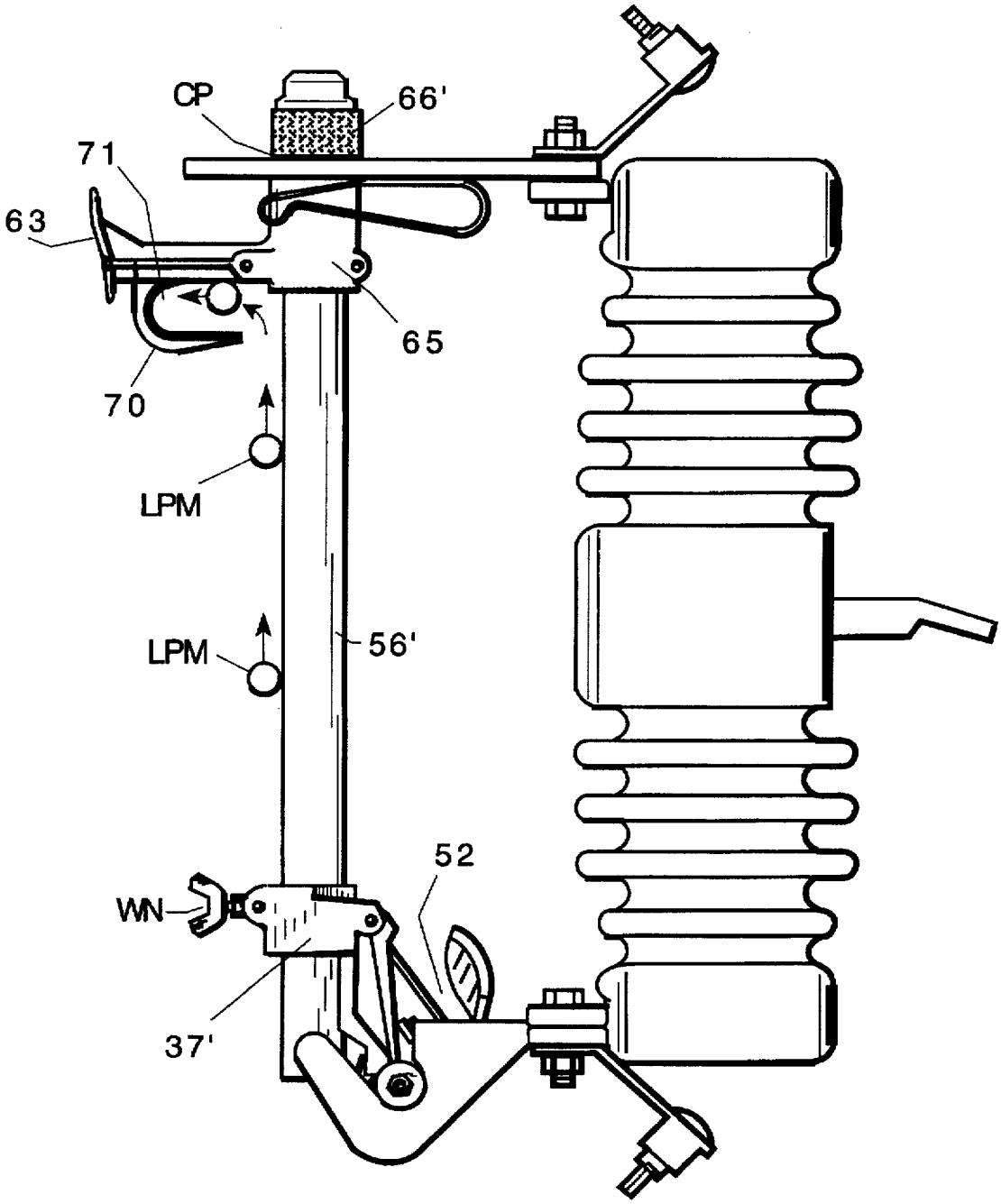
Figure 6B:
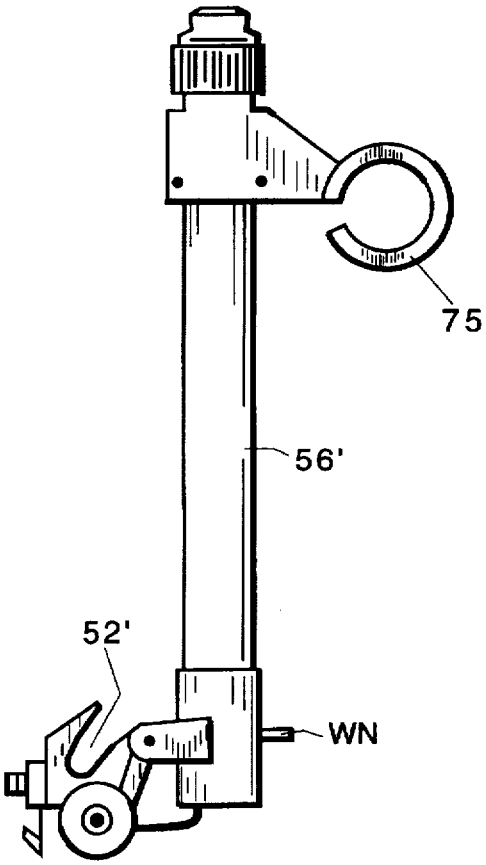
FIG. 6*b* shows a further embodiment.

In order to reflect the full universality of the switch of the present invention, it is shown in FIG. 6, being utilized with a switch manufactured by Chance Manufacturing. In this embodiment, the trunnion mounting collar 37' and wing nut WN have been loosened and the trunnion mounting collar 37' and trunnion assemblies rotated 180°, so that the hook member 70 is on the opposite side from the safety slot 52 in the trunnion contact assembly. In this arrangement, the switch contact is made at the upper end (as shown in FIG. 6) by engagement with the conductive portion CP between the collar 65 and the conductive cap 66. Also in this embodiment, the hook 70 is aligned with the tube body 56 so that by engaging the tube body 56 by the laterally projecting member LPM anywhere along the length thereof as indicated by the circles, the trouble person has a far larger target (from 30–50 feet below) and using the tube body 56, be guided into engagement with hook 70 by raising the hot switch stick and the laterally projecting member LPM to engage slot 71 in hook 70. This is far easier to do than reaching from the ground with a 40–50' pole and trying to fit the laterally projecting member LPM and enlargement BE through the hole such as shown in the various embodiments of FIG. 1.

Moreover, as described earlier, the trouble person operating from below does not have a view of the hole in the eye ring (or hook 40 in FIG. **1*a***) from the side but is viewing at it from an angle on the ground so that the trouble person actually has a smaller visual target. That is to say, the amount of the hole that is visible from 40–50' below and when you are aligned with the edge of the hook or eye ring is quite small.

In the safety device of the present invention is incorporated in the trunnion arms and contact assembly. In this case, the eye ring (normally on a conventional upper contact assembly) is split and use the tube as a guide and slide the disconnect tool into the split opening for disconnecting from the fuse mountings.

Figure 8:
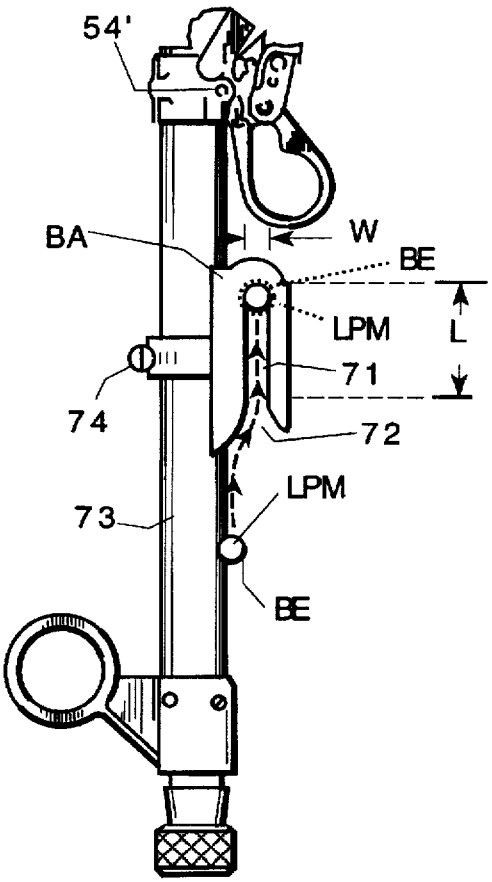
FIG. 8 is a side view of a safety attachment incorporating the invention.

The embodiment shown in FIG. 8, illustrates a safety device which is an attachment for a conventional fuse tube assembly. In this embodiment, a slot 71 having guide opening 72 aligned with the tube body 73 is clamped to the tube body 73 by a hose clamp 74, the base BA of the attachment being curved to snugly fit the curvature of fuse tube 73. In this embodiment, the attachment is applied or affixed to the fuse body and may be made of metal or an industrial ultraviolet resistant plastic material, fiber reinforced, normally between the fuse body 73 and the switch mounting insulator and it is positioned near the trunnion contact assembly so that when the lateral projection member LPM is engaged on the slot 71 and is hanging therefrom, the trunnion can be fitted into the trunnion sockets.

Figure 8C:
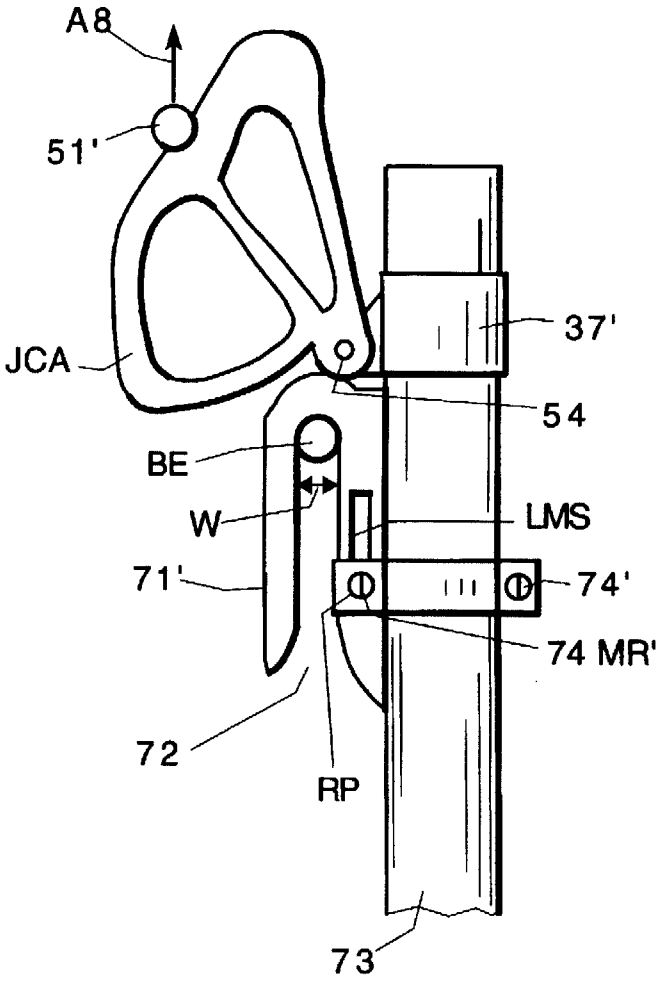
Figure 8B:
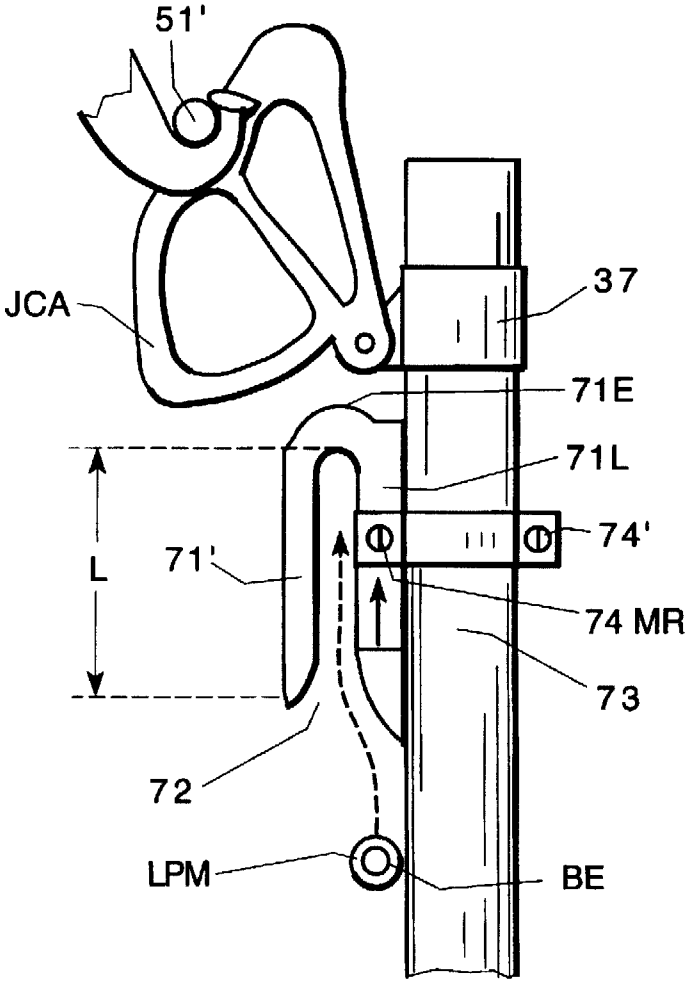

FIGS. **8*a* and 8*b* illustrate a further aspect of the invention in which the head of the hot switch stick has been modified. In this embodiment, the laterally projecting member LPM and its bulbous end BE are aligned with a hook slot 75 which is canted upwardly e.g., it may be curved so as to have its outer or hook end 76 substantially above its lower end 77. This may be a canted construction or, the arm between point 76 and 77 may be curved, or there may be a slight bulbous end 78. In this embodiment, the fuse tube 56 is fitted in the slot 75 and the slot 75 has a width W which is less than the width of collar 37" of the lower trunnion contact assembly so that it does not slide through the space between end slot 75. The canting or curving and the bulbous or upraised portion 78 serves as a retaining member to retain the fuse tube in the slot 75 through jiggling and heavy wind forces and the like. In this case, the fuse tube is raised in the manner illustrated in FIG. 3, this time with the fuse tube being embraced by the slot 75 into position where the trunnions are fitted into the trunnion sockets and the switch operated in a normal fashion. When it is desired to remove the switch from the pole or utility, the laterally projecting member LPM is elevated and bears against the outside surface of fuse tube 56 and then the relative movement between the hot switch stick and the tube 56 in the direction indicated by arrow A1 engages the tube 56 in slot 75 and then the tube, as indicated in FIG. 8*b*, and then the hook 76 is elevated in the direction indicated by arrow A2 to engage the collar 37** and elevate the switch from the trunnion sockets and lower same to the ground.

Thus, there has been disclosed and effective and safe method and apparatus for universal fuse holder and cut-out with built-in safety features.

While preferred embodiments of the invention have been shown and described, it will be appreciated that other embodiments, adaptations and modifications of the invention will be readily apparent to those skilled in the art.

What is claimed is:

1. In a high above-ground distribution fuse cut-out switch system having a pair of spaced contact assemblies supported and spaced by insulator means adapted to be carried on a mounting member, one of said contact assemblies having a pair of laterally aligned trunnion sockets formed therein, an elongated fuse tube assembly having a trunnion contact end with a pair of laterally extending trunnion members receivable in said pair of trunnion sockets, respectively, and a second latching contact end adapted to engage and latch with the second of said contact assemblies when said fuse tube assembly is rotated on said trunnions, the improvement to facilitate safe mounting and demounting of said elongated fuse tube assembly to said pair of spaced contact assemblies from the ground level by a hot/switch stick comprising, said trunnion contact end includes means forming an open ended slot having a width W and wherein said open ended slot has the open end thereof aligned with said elongated fuse tube, said hot/switch stick having an axis and a member projecting laterally of said axis, and an enlargement on the end of said projecting member which is larger than said slot width W, an intermediate portion of said projecting member being narrower than said slot width W such that said projecting member easily slides through said open end into said slot, the weight of said fuse tube and pairs of contact ends and said slot being of a length L such that jiggling and wind forces are insufficient to displace said projection from said slot while said hot/switch stick is being raised to fit said laterally extending trunnion members into said trunnion sockets.

2. The invention defined in claim 1 wherein said open ended slot is such that said lateral projecting member can be rested along the length of said tube and guided along said tube and into said slot to thereby facilitate removal of said trunnion members and fuse assembly from said trunnion sockets.

3. The invention defined in claim 1 or claim 2, including an open sided hook member on said tube adjacent said second latching contact with the open side aligned with said tube so that said projecting member can engage said tube and be easily guided by said tube into engagement with said hook open sided from ground level.

4. The invention defined in claim 1 or claim 2, wherein said trunnion contact end includes a releasable securement means for releasably securing said trunnion contact end to said fuse tube for adjustable rotation of said trunnion contact end around said fuse tube and sliding of said trunnion contact and longitudinally along the length of said fuse tube.

5. A safety attachment for aiding a lineman to mount and demount a fuse cut-out switch using a hot/switch stick having a longitudinal axis and a member projecting laterally of said axis and an enlargement on the end of said member, said fuse having a tubular body and a pair of spaced contact assemblies at the ends thereof, said safety attachment having means forming an open ended slot having a width W and length L, said width W of said slot being smaller than said enlargement, said member having an intermediate portion which is narrower than W, means forming a diverging mouth on said open end of said slot so that the lineman can guide said projection member from movement along said tube into said slot from ground level, said slot having a length L such that, in conjunction with the weight of said fuse cut-out, jiggling and wind and rain forces are insufficient to displace said projection member from said slot while said hot/switch stick is being raised to fit said fuse cut-out to said distribution switch.

6. A method of safely expediting servicing fuse cut-out switches having a trunnion socket contact assembly at one end of an elongated insulator and a latching contact assembly at the opposite end of said insulator and a fuse cut-out having lateral trunnions at one end of a fuse tube and adapted to be received in said trunnion sockets and a latchable contact at the opposite end of said fuse tube and latachable in said latching contact assembly, comprising:

providing an elongated slot on said fuse cut-out adjacent the end of said fuse tube having said lateral trunnions, said slot having a length L and a width W and an open mouth converging to said slot, and a hook switch stick having a laterally projecting member with an enlargement on the end which is larger than said width W, opening said fuse cut-out switch so that said fuse cut-out is suspended solely by said trunnions in said trunnion sockets, guiding the laterally projecting member hook switch stick head into said slot by first engaging said tube below said slot by said laterally projecting member and then, while maintaining said laterally projecting member in engagement with said tube, elevating said laterally protecting member into the mouth of said slot and then into said slot and then, while continuing to elevate said projecting member when it engages the base of said slot to thereby elevate said trunnion members out of engagement with said trunnion slots, the length of said slot being such that jiggling and wind forces are insufficient to displace the laterally projecting member from said slot.

7. The method defined in claim 6 including replacing said fuse cut-out in said trunnion sockets by, on the ground, fitting said laterally projecting member in a fuse cut-out having said slot therein and then elevating said fuse cut-out to the height of said fuse cut-out switch to engage said trunnions with said trunnion socket and rotating said fuse cut-out in said trunnion sockets to engage and latch one end of said fuse cut-out in said latchable contacts.

* * * * *